US009337535B2

(12) United States Patent
Cuchanski et al.

(10) Patent No.: US 9,337,535 B2
(45) Date of Patent: May 10, 2016

(54) LOW COST, HIGH-PERFORMANCE, SWITCHED MULTI-FEED STEERABLE ANTENNA SYSTEM

(71) Applicant: LOCKHEED MARTIN CORPORATION, Bethesda, MD (US)

(72) Inventors: Michael Cuchanski, Newtown, PA (US); Douglas V. McKinnon, Princeton, NJ (US); William J. Taft, Yardville, NJ (US); Gerard J. Matyas, Bala Cynwyd (PA)

(73) Assignee: Lockheed Martin Corporation, Bethesda, MD (US)

( * ) Notice: Subject to any disclaimer, the term of this patent is extended or adjusted under 35 U.S.C. 154(b) by 499 days.

(21) Appl. No.: 13/952,559

(22) Filed: Jul. 26, 2013

(65) Prior Publication Data

US 2014/0028514 A1 Jan. 30, 2014

Related U.S. Application Data

(60) Provisional application No. 61/677,446, filed on Jul. 30, 2012.

(51) Int. Cl.

| | |
|---|---|
| ***H01Q 3/12*** | (2006.01) |
| ***H01Q 3/20*** | (2006.01) |
| ***H01Q 3/24*** | (2006.01) |
| ***H01Q 1/28*** | (2006.01) |
| ***H01Q 19/17*** | (2006.01) |

(52) U.S. Cl.

CPC ..... *H01Q 3/20* (2013.01); *H01Q 1/288* (2013.01); *H01Q 3/24* (2013.01); *H01Q 19/17* (2013.01)

(58) Field of Classification Search

CPC ..... H01Q 3/20; H01Q 1/288
USPC ..... 343/761, 757, 758, 763
See application file for complete search history.

(56) References Cited

U.S. PATENT DOCUMENTS

| | | | | |
|---|---|---|---|---|
| 4,638,322 | A * | 1/1987 | Lamberty | 343/761 |
| 5,949,370 | A * | 9/1999 | Smith et al. | 342/354 |
| 6,268,835 | B1 * | 7/2001 | Toland et al. | 343/781 P |
| 6,441,794 | B1 * | 8/2002 | Tang et al. | 343/781 CA |
| 8,659,493 | B2 * | 2/2014 | Bosshard et al. | 343/761 |
| 2008/0291083 | A1 * | 11/2008 | Chang | 342/354 |
| 2010/0149061 | A1 * | 6/2010 | Haziza | 343/779 |

FOREIGN PATENT DOCUMENTS

EP 2270922 A1 1/2011

* cited by examiner

*Primary Examiner* — Hoanganh Le
(74) *Attorney, Agent, or Firm* — McDermott Will & Emery LLP

(57) ABSTRACT

An apparatus for satellite communication may include a reflector configured to redirect electromagnetic energy. Each of multiple feeds may be positioned at a predetermined location with respect to the reflector. A feed-switching mechanism may be configured to selectively activate for use at least one of the multiple feeds. A steering mechanism may be configured to steer the reflector such that a focal point of the reflector approximately coincides with a position of an activated feed of the multiple feeds. The reflector may be mechanically independent of the plurality of feeds and the feed-switching mechanism.

20 Claims, 10 Drawing Sheets

(Prior Art)

LOW COST, HIGH-PERFORMANCE, SWITCHED MULTI-FEED STEERABLE ANTENNA SYSTEM

CROSS-REFERENCE TO RELATED APPLICATIONS

This application claims the benefit of priority under 35 U.S.C. §119 from U.S. Provisional Patent Application 61/677,446 filed Jul. 30, 2012, which is incorporated herein by reference in its entirety.

STATEMENT REGARDING FEDERALLY SPONSORED RESEARCH OR DEVELOPMENT

Not applicable.

FIELD OF THE INVENTION

The present invention generally relates to satellite antennas, and more particularly to a low cost, high-performance, switched multi-feed steerable antenna system.

BACKGROUND

Many satellite communication systems may use devices known as single reflector antennas as the means of sending electromagnetic signals. Such antennas may include a reflector surface, either paraboloid or otherwise shaped, and a feed placed at or near the reflector focus. The antenna may operate in a receiving mode, transmitting mode, or both simultaneously. The electromagnetic energy received or transmitted by the antenna may be collimated into a narrow beam and directed from the satellite towards a specified location on the earth surface. This location may be fixed for the duration of the mission, except for minor adjustments, in which case the antenna structure and the mounting method is static and relatively simple. However, very often the antenna direction of radiation may vary, either because the requirements of the mission have changed, or because the intended target travels as a function of time. The antenna needs to be steered to direct the beam towards a specified location. Such steerable antennas have to incorporate special features in their mechanical and electrical design in order to perform their function.

Current implementation options for steerable beam antennas are principally governed by tradeoffs of performance/functionality vs. cost/mass/volume. The antenna designer may be faced first with two main choices. One is a fully steerable system, where the reflector and the feed form a single mechanical assembly, are placed together on a gimbal steering mechanism, and controlled as a unit. This type of system offers the best performance, virtually invariable with the scan angle. However, it may have two main drawbacks. First, it may require an RF rotary joint or a flexible waveguide connection at the interface between the steerable antenna and the RF transponder circuitry. Solutions to this RF interface issue have been addressed by installing the RF transponder circuitry onto the antenna eliminating the need for a flexible interface, but this may limit the utility and may result in significant increases in deployed/gimbaled mass. Second, such a solution may be unacceptably costly to implement, and may require large volume, mass, and sturdy gimbal mechanisms. Third, stowage of multiple full steered antennas can be problematic, driving spacecraft launch vehicle faring size and cost. Achieving sufficiently high rates of motion, meeting acceleration/deceleration limits, and ensuring cycle lifetimes may all be very difficult. For these reasons, with the exception of small steerable antennas, fully steerable systems are rarely practical.

The second choice is a system with an independently steerable reflector and a fixed feed. In this type of steerable antenna, only the reflector is placed on a gimbal steering mechanism. The feed is mounted on the satellite body and may not require a rotary joint for its connection to the transponder. Since the reflector mass is relatively small, it is possible to use economic light-weight gimbals, achieve high rates of motion, and long cycle lifetimes. However, a steerable antenna with a rotating reflector and a fixed feed may suffer from a loss of performance (e.g., decrease in peak gain and changes in the beam shape) as the steering angle increases. This loss of performance is usually referred to as the scan loss. When the reflector rotates in order to steer the beam towards the desired direction, the focal point of the reflector may move away from the fixed feed, and the ray relationship between the feed and the reflector may gradually become less optimal. For large diameter antennas that need to steer over a wide range of scan angles, the scan loss may be high (2-5 dB as an example) and therefore prohibitive. Nevertheless, the systems with an independently steered reflector and a fixed feed are often the only practical option.

For the steerable antenna systems using a steerable reflector and a fixed feed, there are in turn two main design options, again trading off performance vs. cost/mass/volume. The first design option is a reflector rotated about center, where the gimbal mechanism is placed behind the reflector surface, with the center of rotation near or in the vicinity of the aperture center. Since the reflector center is then approximately stationary, and the movement of the reflector rim relative to the feed is minimized, the scan loss may be minimized. However, placing the gimbal at the aperture center, which usually means away from the spacecraft body, is often difficult to implement, requires additional mass and volume, and may be impossible to accommodate for multiple reflectors systems stowed in an overlapped configuration.

The second design option is a reflector rotated about vertex, where the gimbal mechanism is placed in the vicinity of the reflector vertex. This is the most convenient location from the viewpoint of mechanical implementation, with the gimbal located close to the spacecraft body, allowing a compact, low mass, low cost solution. This approach allows for more compact stowage, and enables stowage of multiple nested reflectors along a single side of the spacecraft. However, because the reflector displacement relative to the feed is larger than for the reflector rotated about the center, the scan loss for this method is unfortunately much higher. In spite of the advantages of its mechanical implementation, the scan performance of a reflector steered about its vertex, for the same range of scan angles, is usually inferior.

SUMMARY

In some aspects, an apparatus for satellite communication is described. The apparatus may include a reflector configured to redirect electromagnetic energy. Each of the multiple feeds may be positioned at a predetermined location with respect to the reflector. A feed-switching mechanism may be configured to selectively activate for use at least one of the multiple feeds. A steering mechanism may be configured to steer the reflector such that a focal point of the reflector approximately coincides with a position of an activated feed of the multiple feeds. The reflector may be mechanically independent of the plurality of feeds and the feed-switching mechanism.

In other aspects, a method for providing a satellite communication antenna may include providing a reflector that redirects electromagnetic energy. Multiple feeds may be positioned at a predetermined location with respect to the reflector. A feed-switching mechanism may be configured to selectively activate for use at least one of the multiple feeds. A steering mechanism may be configured to steer the reflector such that a focal point of the reflector approximately coincides with a position of an activated feed of the plurality of feeds. The reflector may be mechanically independent of the plurality of feeds and the feed-switching mechanism.

In yet other aspects, a low-cost, low scan-loss satellite antenna may include a reflector coupled to a steering mechanism and configured to redirect electromagnetic energy. The steering mechanism may be configured to steer the reflector to a position that focuses a spot beam of the antenna on a target. A feed-switching mechanism may be configured to selectively activate for use at least one of multiple feeds of a network of feeds. A focal point of the reflector may approximately coincide with a position of an activated feed of the plurality of feeds, and the reflector may be mechanically independent of the plurality of feeds and the feed-switching mechanism.

The foregoing has outlined rather broadly the features of the present disclosure in order that the detailed description that follows can be better understood. Additional features and advantages of the disclosure will be described hereinafter, which form the subject of the claims.

BRIEF DESCRIPTION OF THE DRAWINGS

For a more complete understanding of the present disclosure, and the advantages thereof, reference is now made to the following descriptions to be taken in conjunction with the accompanying drawings describing specific aspects of the disclosure, wherein.

DETAILED DESCRIPTION

The present disclosure is directed, in part, to methods and configurations for providing low cost, high performance, switched multi-feed steerable antennas. The subject technology is generally directed to satellite antennas, and in particular to multi-feed (e.g., more than one, for example, five feeds or more) antenna solutions that can provide scan performance approaching that of a fully steered system while at the same time maintaining the cost advantages of a vertex steered system. In some aspects, using additional feeds along with a switch selection network, the scanned beam performance of the vertex-steered antenna system can be made to closely approximate the performance of the fully-steered antenna. The subject technology may improve upon the existing solutions by enhancing the performance, for example, by 4 dB, and providing a worst case scan loss of ~2 dB (e.g., at limb of earth) and areas of less than ~1 dB, in significant portions of a characteristic scan loss versus scan-angle plot, as discussed in greater detail herein.

Figure 1C:
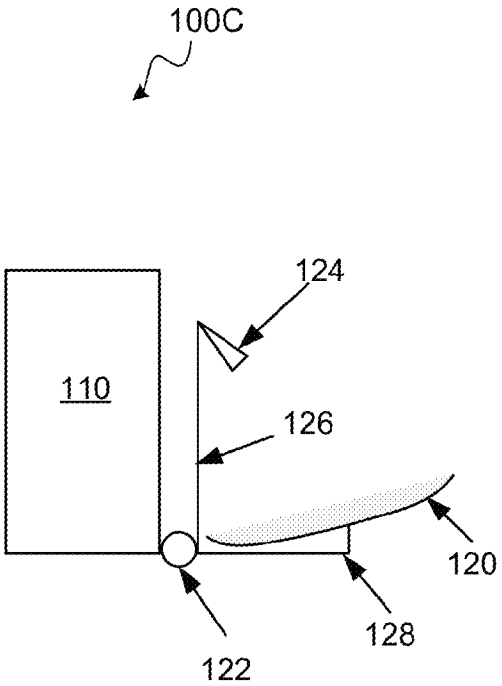
FIGS. 1A-1C are diagrams illustrating various antenna beam steering configurations.
Figure 1B:
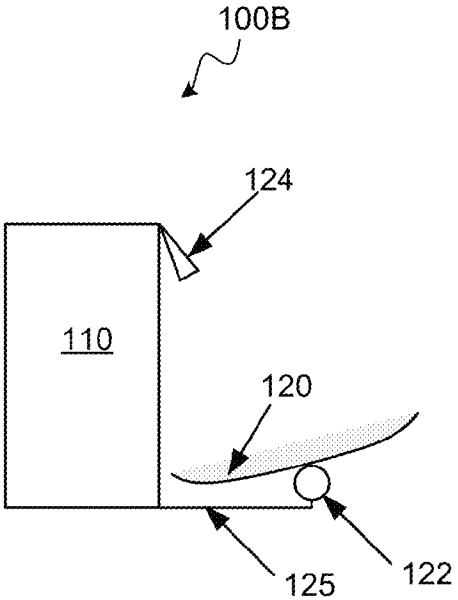
Figure 1A:
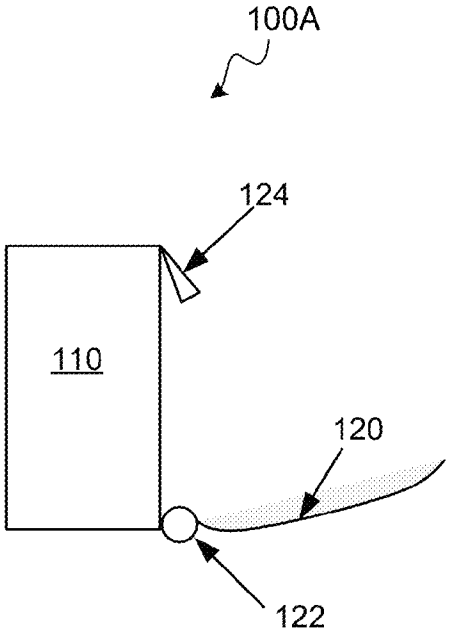

FIGS. 1A-1C are diagrams illustrating various antenna beam steering configurations. A schematic of a typical vertex-steered antenna system is shown in FIG. 1A. FIG. 1A shows a schematic diagram of a typical vertex-steered antenna system 100A where a single feed 124 and a bi-axis steering mechanism (hereinafter "steering mechanism") 122 are fixed to a support structure 110, and a reflector 120 can be steered by the steering mechanism 122. An alternative configuration is a center-of-reflector steered antenna system 100B, as shown in FIG. 1B, where the steering mechanism 122 is coupled through an arm 125 to the support structure 110. The antenna system 100B can provide slightly better scan-loss performance than the antenna system 100A. Yet another antenna system may allow the entire mechanical antenna system to be fully steered. The fully steered antenna system 100C, shown in FIG. 1C, includes the single feed 124 that is connected via a first arm 126 and a second arm 128 to the reflector 120. In some aspects, the first and second arms 126 and 128 can be mechanically common and form or a single structure. Both the first and second arms 126 and 128 are fixed to the steering mechanism 122 fixed to the support structure 110. The entire antenna system can be steered by the steering mechanism 122.

The fully steered antenna system 100C may provide essentially a desired scan-loss performance, but at a high cost. The high cost of the fully-steered system 100C may be due to the required launch packaging components (e.g., launch locks, deployment hinges, etc.) and the systems required to pass radio frequency (RF) signals across a moving interface (e.g., RF rotary joints or flexible waveguide).

A desirable antenna solution for satellite designers should provide scan performance approaching that of the fully steered system (e.g., 100C), while at the same time maintaining the cost advantages of a vertex-steered antenna system (e.g., 100C) that is modified to closely approximate the performance of the fully-steered antenna system 100C. The antenna systems 100A-C, are either high-cost systems with excellent scanned beam performance (e.g., system 100C), medium-cost and medium performance systems (e.g., system 100B), or relatively low-cost systems with compromised scanned beam performance (e.g., system 100A). The subject technology may drastically improve in performance, cost, and compactness upon these solutions by using a switch network to allow selection of one or more feeds, based on the application, as described herein.

The subject disclosure describes a steerable antenna system that overcomes the performance problems of a system with a reflector rotated about its vertex (e.g., 100A), while retaining the simplicity and low cost advantages of its mechanical realization. The resulting performance levels may be comparable or superior to the scan performance achievable with a reflector system rotated about its center (e.g., 100B). Stowage of nested reflectors is readily achievable. More importantly, the subject technology may use multiple switchable feeds, placed in fixed positions corresponding to the positions of the reflector focal point as a function of the steering angle. The feeds may be fixed to the spacecraft body, eliminating the need for flexible RF interfaces when changing the beam pointing. The subject technique is not limited to the vertex system, but is also applicable and can be equally well employed in the context of the center rotated reflector system, enhancing its scan performance even further.

Figure 2:
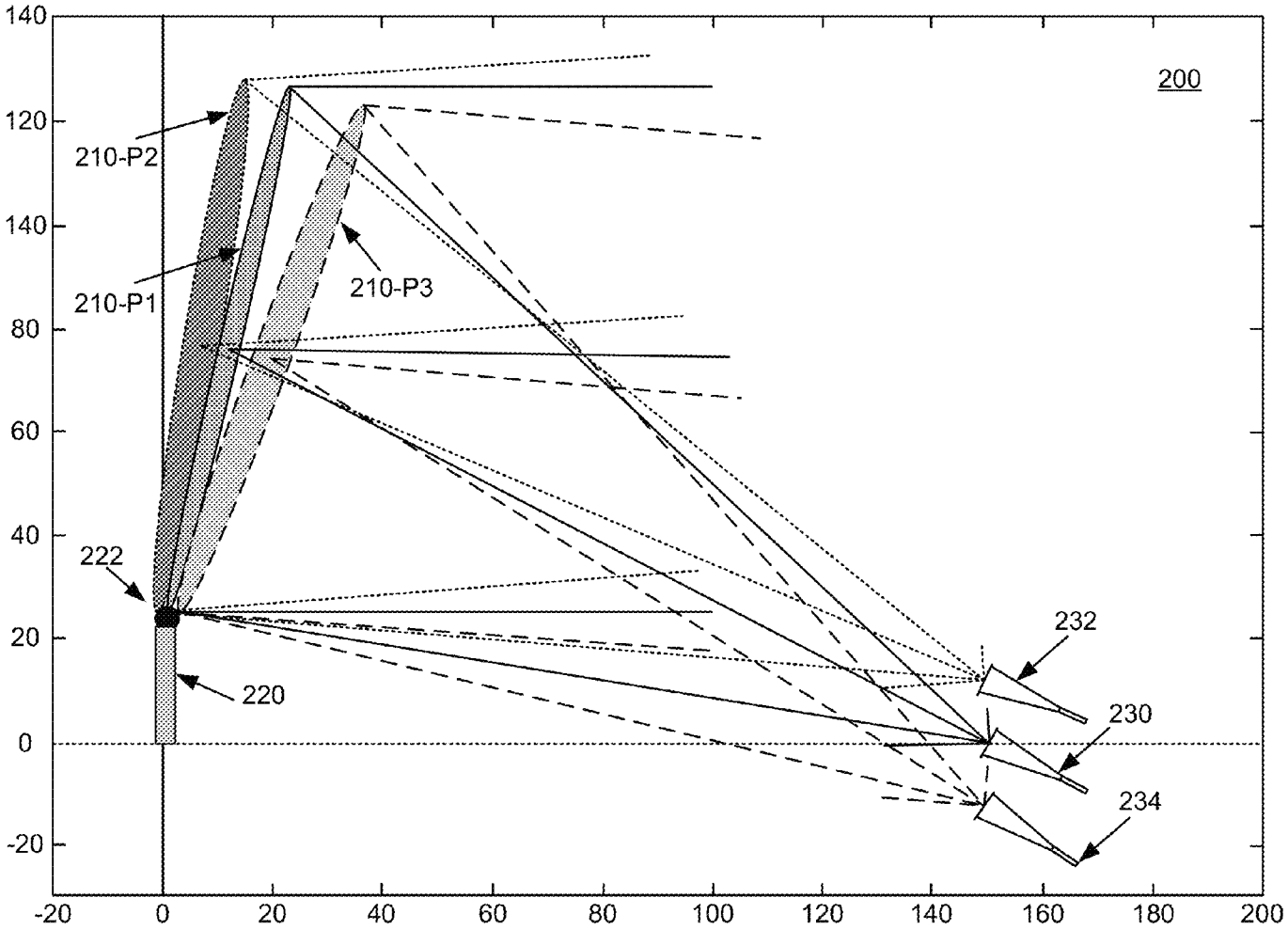
FIG. 2 is a conceptual diagram illustrating a side-view of an example of a vertex-steered switched-feed antenna system, according to certain aspects.

FIG. 2 is a conceptual diagram illustrating a side-view of an example of a vertex-steered switched-feed antenna system 200, according to certain aspects of the subject technology. The antenna system 200 may include multiple feeds, such as feeds 230, 232, and 234, a reflector 210, and a steering mechanism 220 including a gimbal, only a vertex 222 of which is symbolically shown in FIG. 2. The reflector 210 may rotate about the vertex 222, in at least two dimensions, to steer scanned beams. The antenna system 200 may be used to selectively work with one of the multiple feeds (e.g., 230, 232, or 234) according to one of three (or more) positions (e.g., P1, P2, and P3) of the reflector 210. In the example shown in FIG. 2A, a plane of the reflector 210 in position P1 is directed to ~5.76 degree north-west, the a beam of the reflector 210 in position P2 is pointing at nadir, and a plane of the reflector 210 in position P3 is directed is at ~5.76 degree south-east.

For each position of the reflector 210, one of the multiple feeds may be selected by a switch network described herein. The location of the feeds 230, 232, and 234 may be configured such that each feed is positioned at a focal point (e.g., antenna focal point) of the reflector 210 at one of the positions (e.g., P1, P2, or P3). For example, as shown in FIG. 2, the feeds 230, 232, and 234 are, respectively, positioned in the focal point of the reflector 210 at positions P1, P2, and P3. In one or more aspects, beam scanning may be performed by rotating the reflector 210 using the steering mechanism 220, for selecting one of the feed-reflector switchable configurations as a scan departure state minimizing scan-angle and scan-loss.

Figure 3:
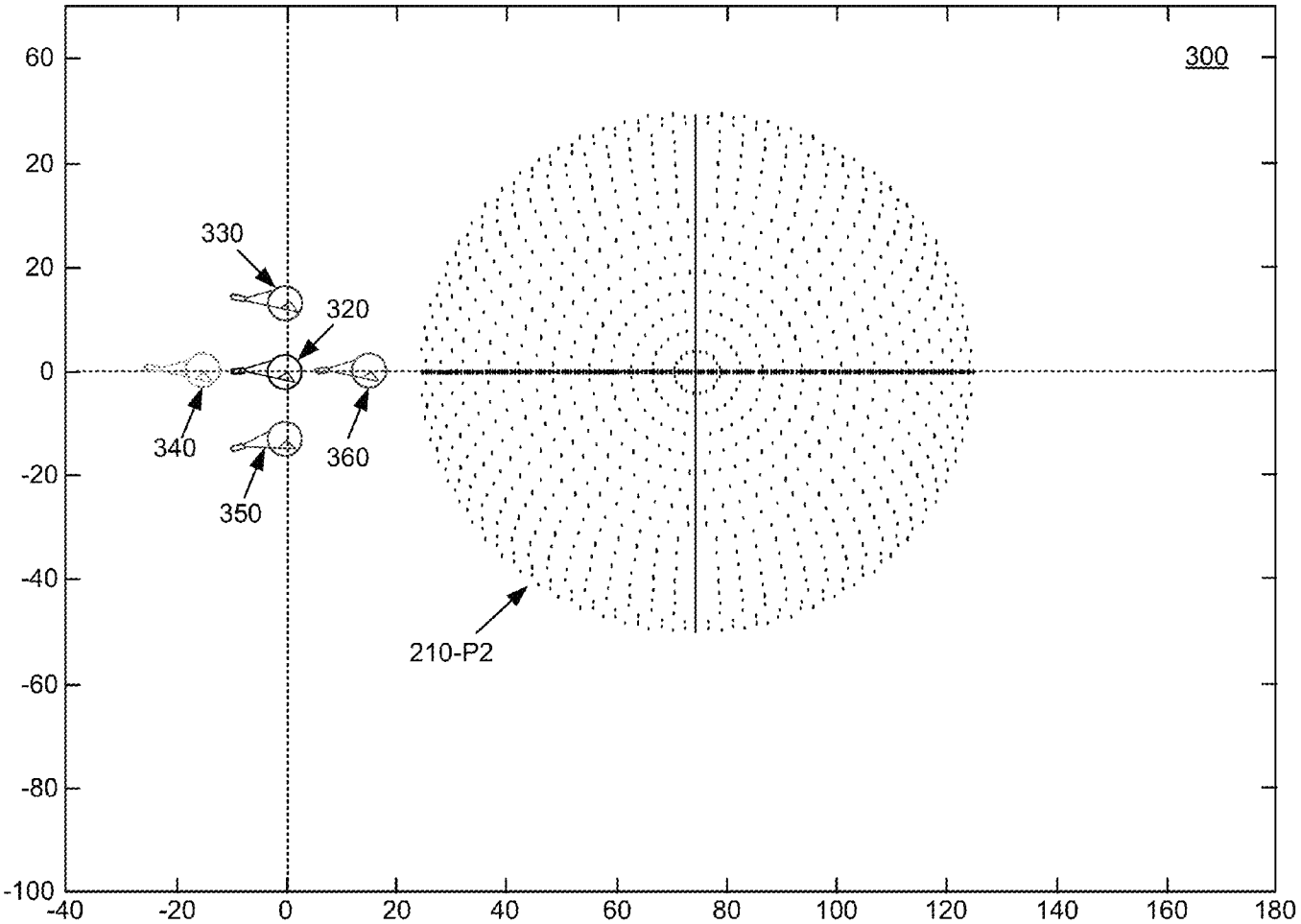
FIG. 3 is a conceptual diagram illustrating an X-Y plane view of an example of a vertex-steered switched-feed antenna system, according to certain aspects.

FIG. 3 is a conceptual diagram illustrating an X-Y plane view of an example of a vertex-steered switched-feed antenna system 300, according to certain aspects of the subject technology. The antenna system 300 includes a reflector 210 and multiple feeds (e.g., five feeds 320, 330, 340, 350, and 360). In the example depicted in FIG. 3, a top-view of the reflector 210 of FIG. 2 pointing at nadir (e.g., 210-P2 at position P2) is shown. For each feed-reflector configuration, one of the multiple feeds may be selected based on one of (e.g., five or more) positions of the reflector 210. The feed-reflector configurations may, for example, include nadir pointing (shown)with the feed 320, 5.76 degree north-west pointing with the feed 360, 5.76 degree south-east pointing with the feed 340, 4.99 degree north-east pointing with the feed 330, and 4.99 degree south-west pointing with the feed 350. Beams may be scanned by rotating the reflector 210 using the vertex positioning mechanism (e.g., steering mechanism 220 of FIG. 2). Scanned beam performance may be optimized by switching to the feed that minimizes the angular distance between the optimal focal point that is associated with a position of the reflector 210.

Figure 4:
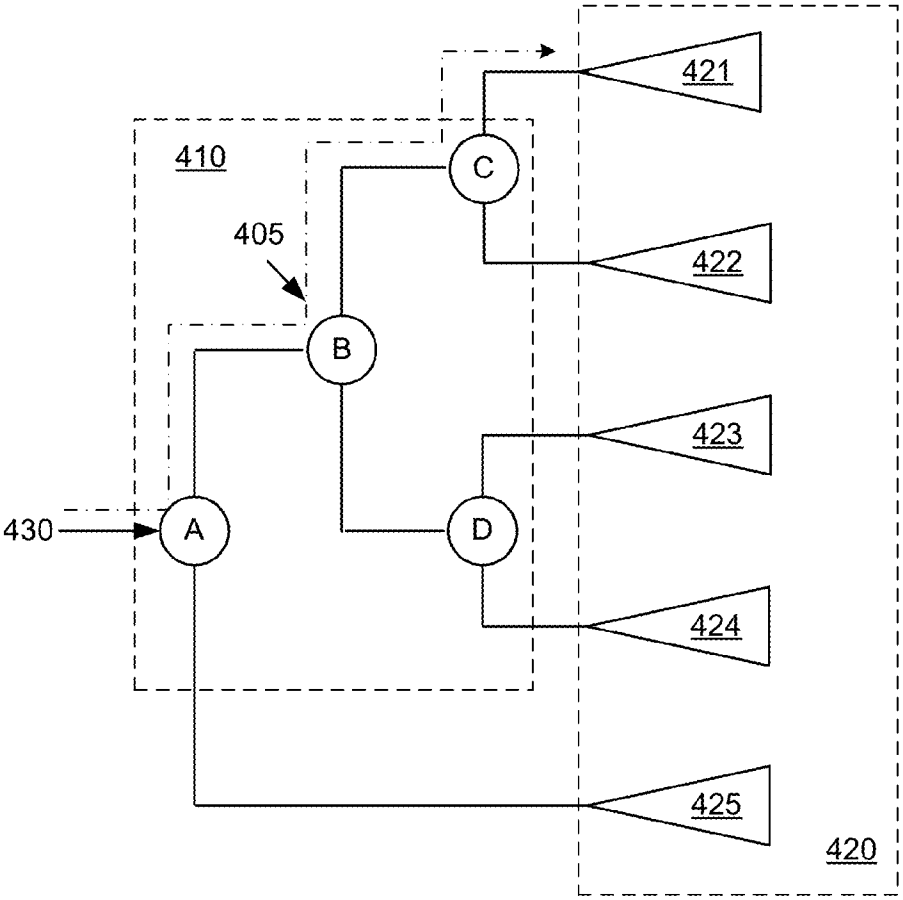
FIG. 4 is a conceptual diagram illustrating an example of a switch network for use with a vertex-steered switched-feed antenna system, according to certain aspects.

FIG. 4 is a conceptual diagram illustrating an example of a switch network 410 for use with a vertex-steered switched-feed antenna system of FIGS. 2-3, according to certain aspects of the subject technology. For example, the switch network 410 may be used for activating an optimal feed of the multiple feeds 420, which includes feeds 421-425. The switch network 410 includes RF switches A, B, C, and D, each of which may be a two-position switch selecting between two feeds. In the example switch network 410, an RF signal 430 may enter the switch network 410 through the RF switch A and propagate through two more switches to a selected feed. For example, to select feed 421 (e.g., to generate a beam 1), the RF switches A, B, and C are properly set to direct the RF signal 430 through the route 405 to the feed 421. Each of the other feeds can be selected by using similar settings of corresponding switch/switches in a route from the input switch A to that feed. In some aspects, the network switch 410 may have more or less number of RF switches in one or more configurations different from the configuration of the RF switches shown in FIG. 4.

Figure 5:
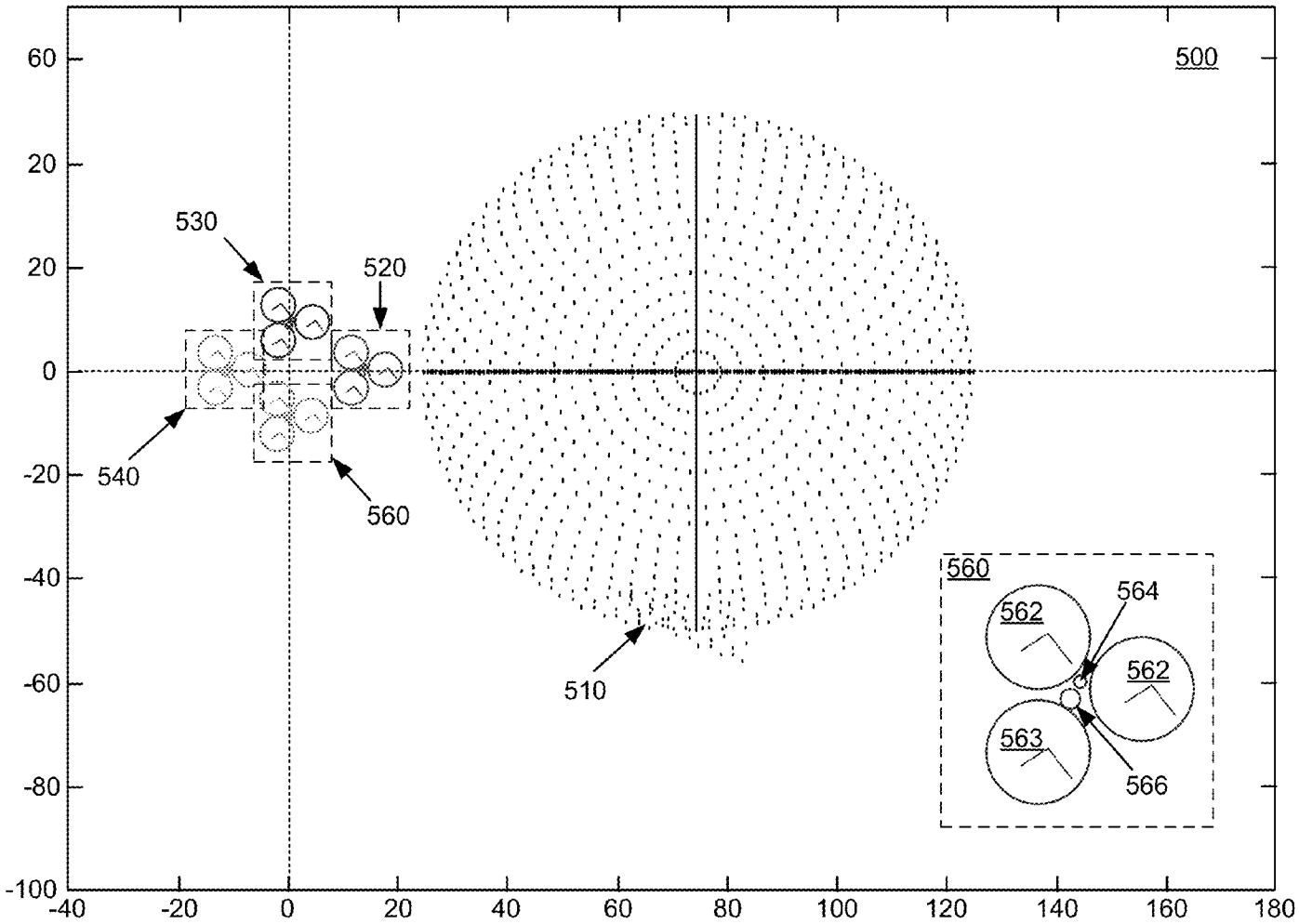
FIG. 5 is a conceptual diagram illustrating an X-Y plane view of an example of a vertex-steered switched-feed antenna system including feeds optimized for multiple frequency bands, according to certain aspects.

FIG. 5 is a conceptual diagram illustrating an X-Y plane view of an example of a vertex-steered switched-feed antenna system 500 including feeds optimized for multiple frequency bands, according to certain aspects of the subject technology. The antenna system 500 includes a reflector 510 and a number of groups of feeds (e.g., groups 520, 530, 540, and 560). The reflector 510, in the position shown in FIG. 5, is pointing towards nadir, and the groups of feeds 520, 530, 540, and 560 are for ~pointing at: 5.76 degree north-west, ~4.99 degree north-east, ~5.76 degree south-east, and ~4.99 degree south-west directions, respectively. The four selectable groups of feeds 520, 530, 540, and 560 may cover, for example, multiple (e.g., three) distinct frequency bands, and are located approximately at each scanned focal point location associated with a corresponding position of the reflector 510.

Each of the groups of feeds (e.g., groups 520, 530, 540, and 560) may include a number of feeds of different sizes. For example, the group 560 may include three or more large feeds 562 and one or more smaller feeds such as 564 and 566. The smaller feeds 564 and 566 can operate at higher frequencies than the large feeds 562. In some aspects, a feed-switching mechanism may selectively activate two or more low-frequency feeds 562 at the same time, so that the two or more low-frequency feeds 562 can collectively operate as an equivalent larger feed. A steering mechanism (e.g., 220 of FIG. 2) may steer the reflector 510 such that a focal point of the reflector 510 coincides with a central point of the positions of the two or more low-frequency feeds.

In some aspects, the antenna system 500 may cover more or less than three distinct frequency bands. In some aspects, the two higher frequency bands may use one of feeds 564 and 566 per focal point location and the third lower frequency band may be implemented using a three element array formed by feeds 562. Beam scanning may be performed, for example, by rotating reflector 510 with a steering mechanism by first selecting one of the feed-reflector switchable configurations, as a scan departure state, and minimizing scan-angle and scan-loss. For example, as the scan-loss deviates from the departure state, the scan-loss increases, and at some point a new feed-reflector configuration can be selected to decrease the scan-loss.

Figure 6:
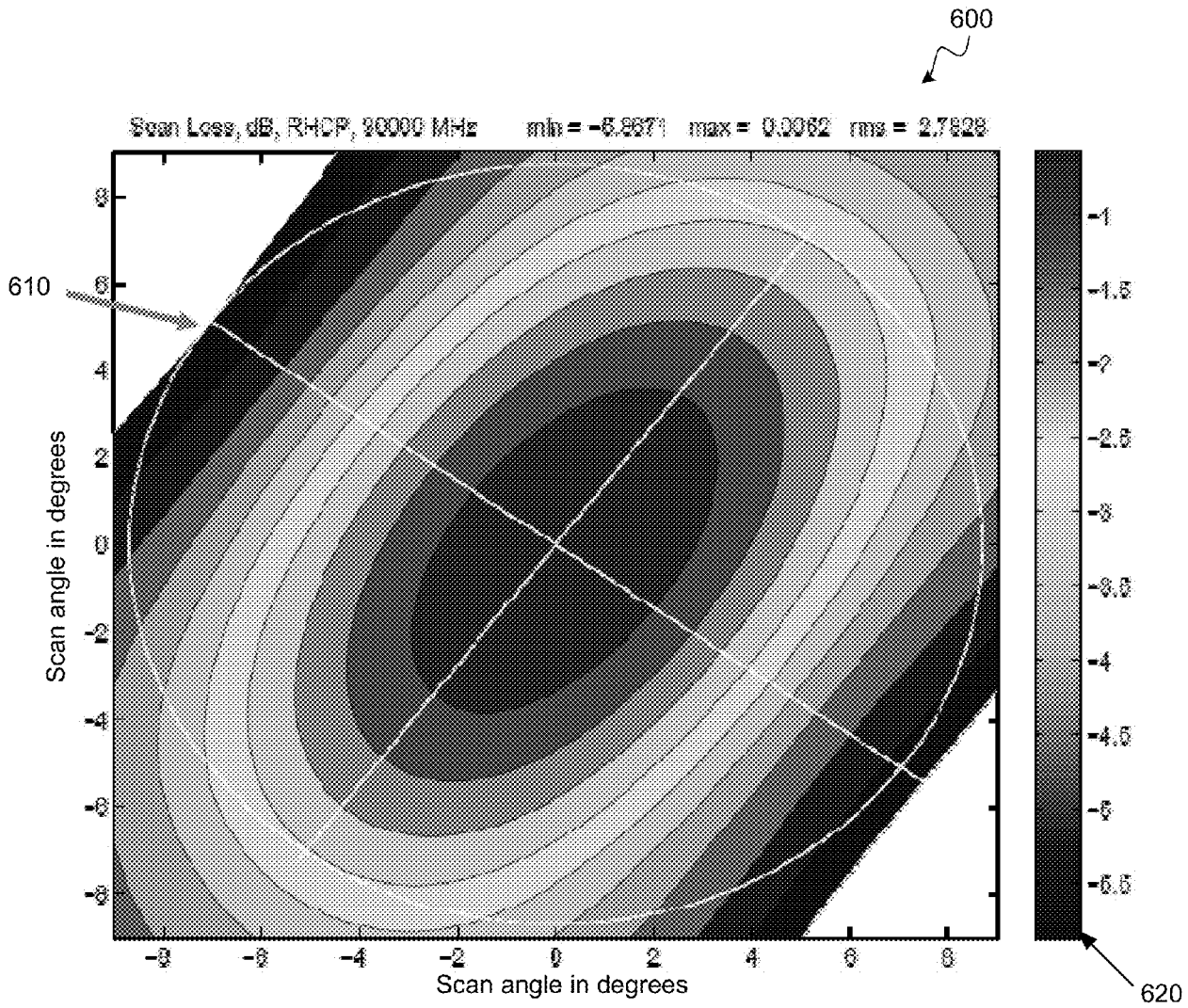
FIG. 6 is a diagram illustrating an example of a loss vs. scan-angle contour for a single-feed vertex-scanned offset-fed antenna system of FIG. 1A.

FIG. 6 is a diagram illustrating an example of a scan loss vs. scan-angle contour 600 for a single-feed vertex-scanned offset-fed antenna system of FIG. 1A, according to certain aspects of the subject technology. The legend 620 shows the correspondence of the contour gray scale with the scan-loss numbers from 0.5 dB to 7 dB. The contour 600 shows that the lowest scan-loss occurs in the middle of the contour where the scan-angle is at zero degrees with respect to the departure state. The scan-loss increases as the scan-angle increase, on both directions, until it reaches ~6dB at the limb of the earth depicted by the circle 610. Further, the contour 600 shows that a larger part of the contour area is covered with areas of scan-loss higher than ~3db, and the low loss (e.g., less than ~1dB) areas are limited to a small portion (e.g., the middle zone) of the area of the contour 600.

Figure 7:
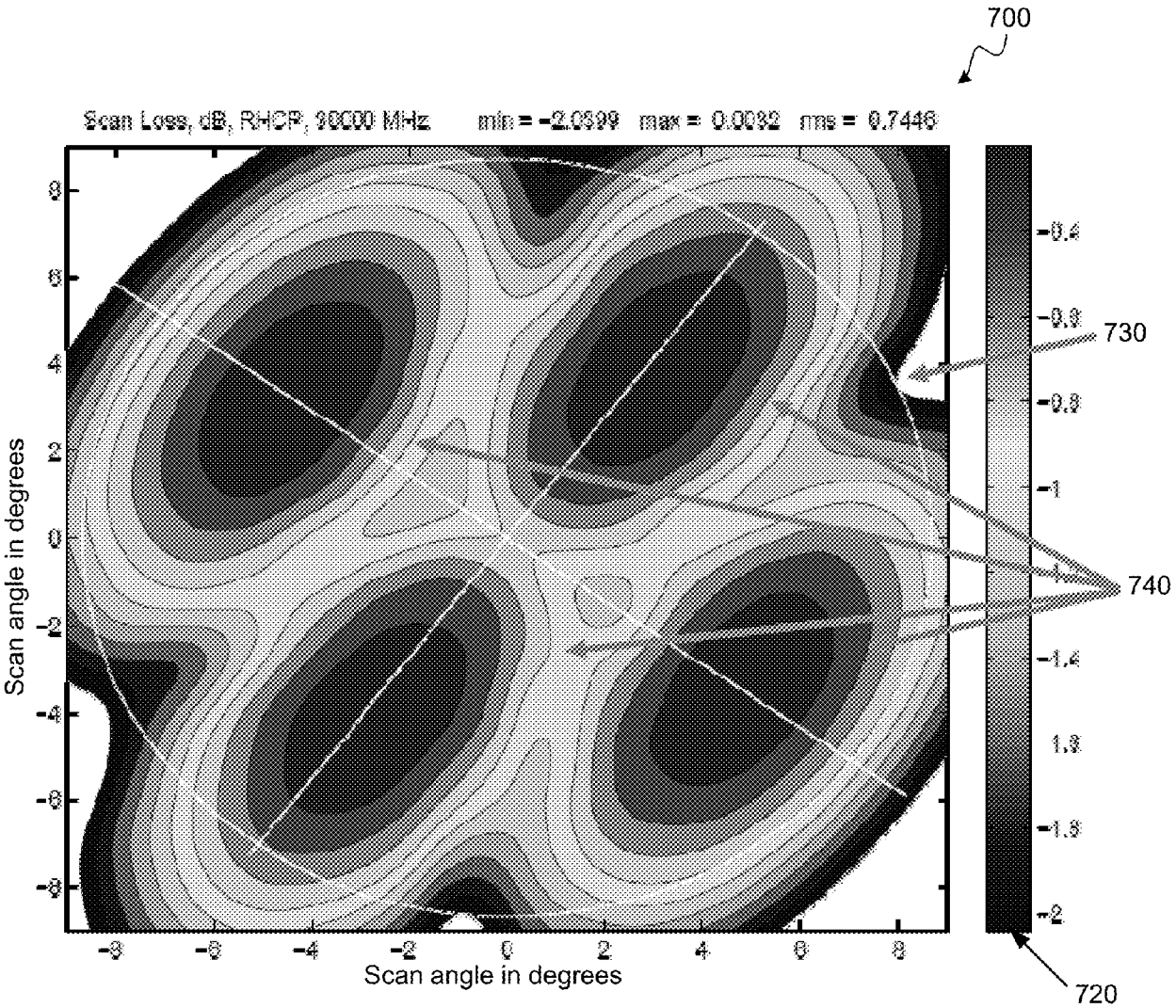
FIG. 7 is a diagram illustrating an example of a loss vs. scan-angle contour for a four-feed vertex-scanned switched-feed antenna system, according to certain aspects.

FIG. 7 is a diagram illustrating an example of a scan-loss vs. scan-angle contour 700 for a four-feed vertex-scanned switched-feed antenna system, according to certain aspects. The legend 720 shows the correspondence of the contour gray scale with the scan-loss numbers from 0.2 dB to ~2dB. The contour 700 shows a large area 740, with less than ~1 dB performance, which is significantly larger the corresponding area in the prior art, as shown in FIG. 6. Further, the worst case scan-loss of ~2 dB, at the limb of the earth shown by a circle 730 is ~4 dB lower than the prior art, as shown in FIG. 6. The contour 700 also reveals four low-loss (e.g., less than ~0.4 dB) zones corresponding to four feed-reflector configurations.

Figure 8:
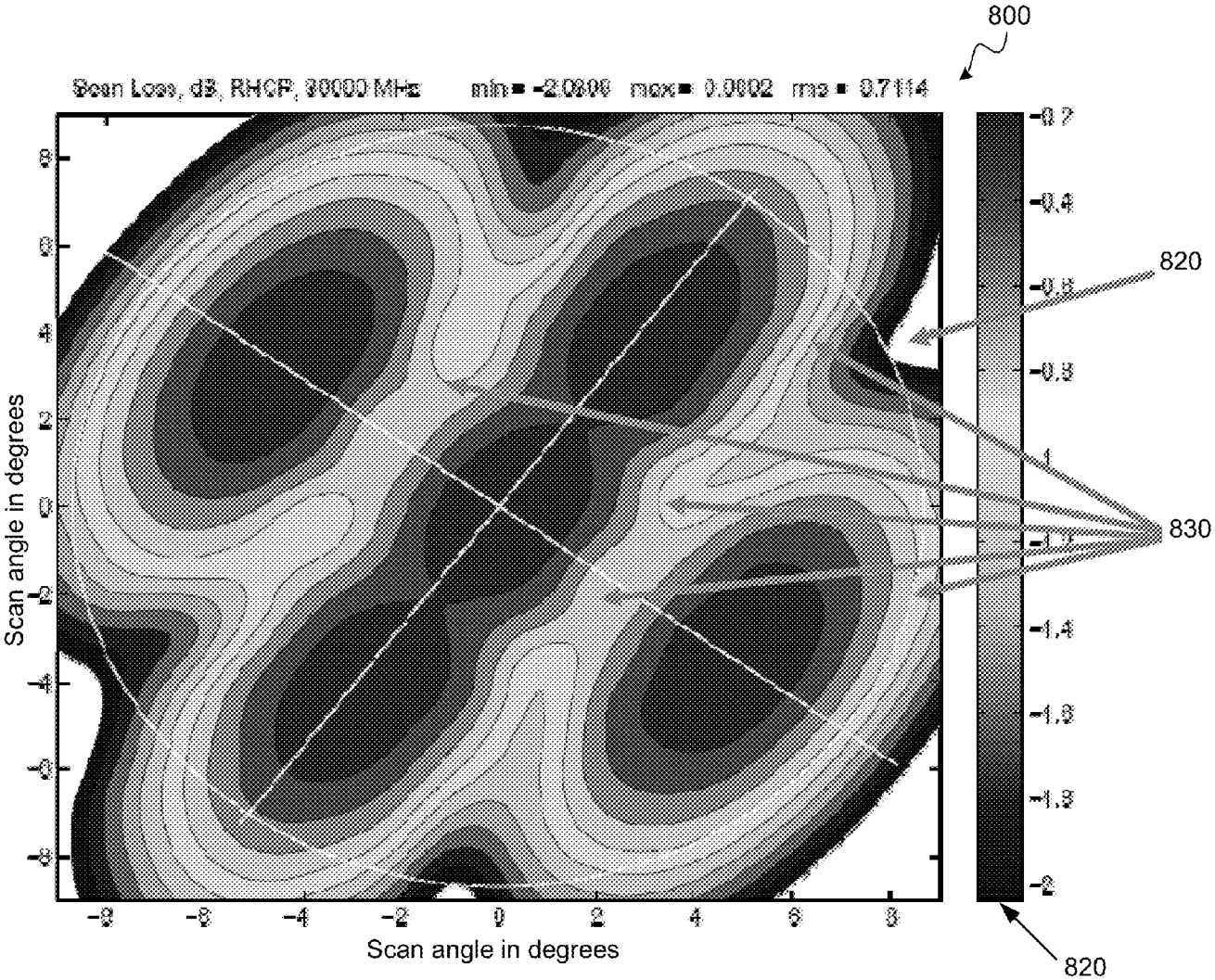
FIG. 8 is a diagram illustrating an example of a loss vs. scan-angle contour for a five-feed vertex-scanned switched-feed antenna system, according to certain aspects.

FIG. 8 is a diagram illustrating an example of a scan-loss vs. scan-angle contour 800 for a five-feed vertex-scanned switched-feed antenna, according to certain aspects of the subject technology. The legend 820 shows the correspondence of the contour gray scale with the scan-loss numbers from 0.2 dB to ~2 dB. The contour 800 shows a large area 830, with less than 1 dB performance, which is even larger than the corresponding area of the four-feed configuration of FIG. 7, and substantially larger than the corresponding area in the prior art, as shown in FIG. 6. The worst case scan-loss of ~2 dB, at the limb of the earth shown by a circle 820 is ~4 dB lower than the prior art, as shown inn FIG. 6. It is noted that the number of feeds is not limited to five and the scan-loss performance can be further enhanced by adding more feeds and providing a steering mechanism that allows for the reflector positions (e.g., angles) associated with the feeds.

Figure 9:
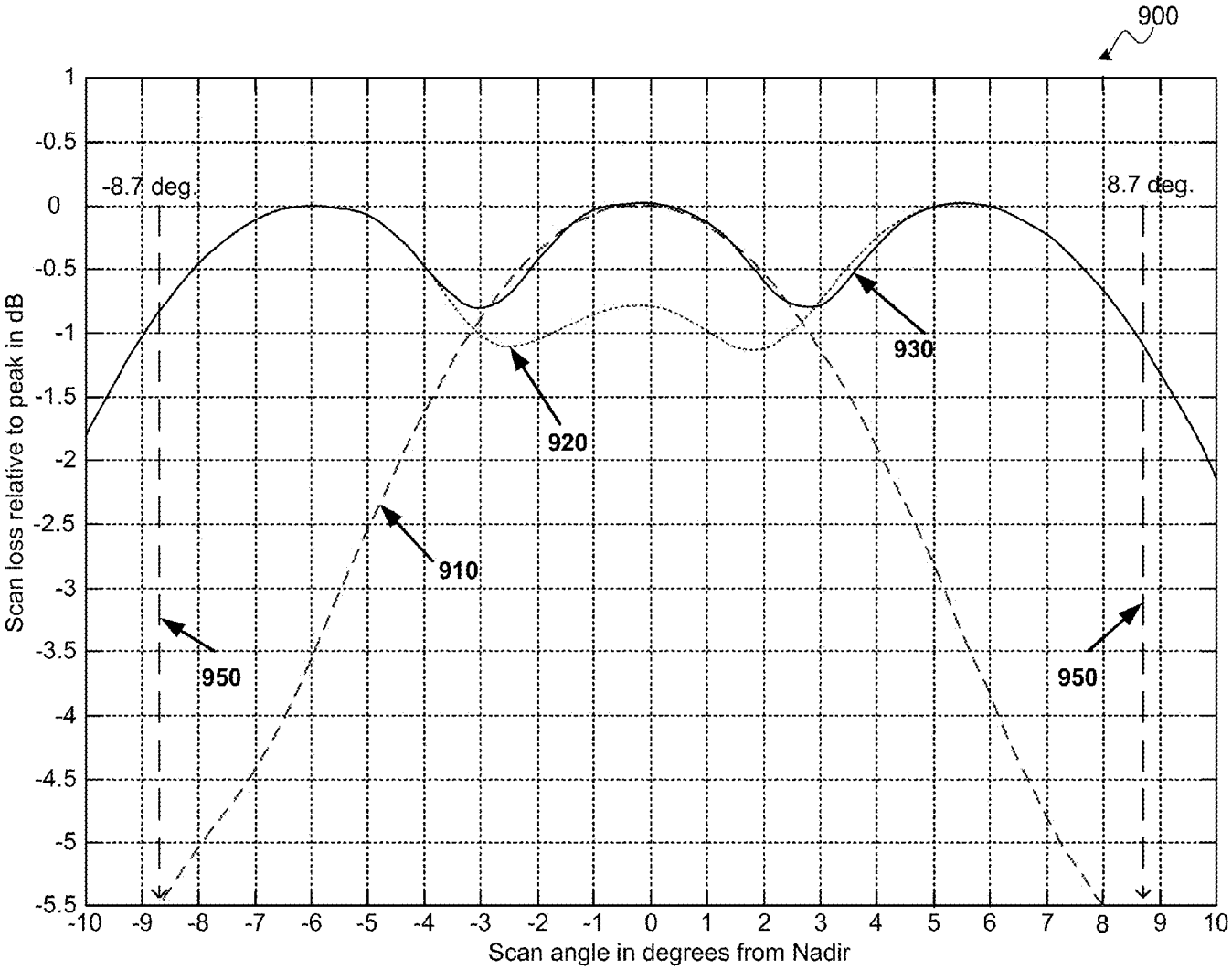
FIG. 9 is a diagram illustrating an example of a loss vs. scan-angle chart for four- and five-feed vertex-scanned switched-feed antenna systems, according to certain aspects.

FIG. 9 is a diagram illustrating an example of a scan-loss vs. scan-angle chart 900 for four and five-feed vertex-scanned switched-feed antenna systems, according to certain aspects of the subject technology. The chart 900 shows plots of scan-loss vs. scan-angle from south-east towards north-west. Plots 910, 920, and 930, respectively, correspond to a single-feed, four-feed, and five-feed antenna systems. The lines 950 show the 8.7 degree limits that correspond to the earth limb. As shown by the plots, the scan loss for the single-feed system (e.g., plot 910) increases sharply as the scan angle deviates from the center portion (e.g., −2 to 2 degrees), whereas for the four and five-feed systems (e.g., plots 920 and 930) the scan loss continue to stay low for the entire scan angles between earth limb lines 950. The five-feed system (e.g., plots 930) is shown to have a better performance than the four-feed system (e.g., plots 920).

Figure 10:
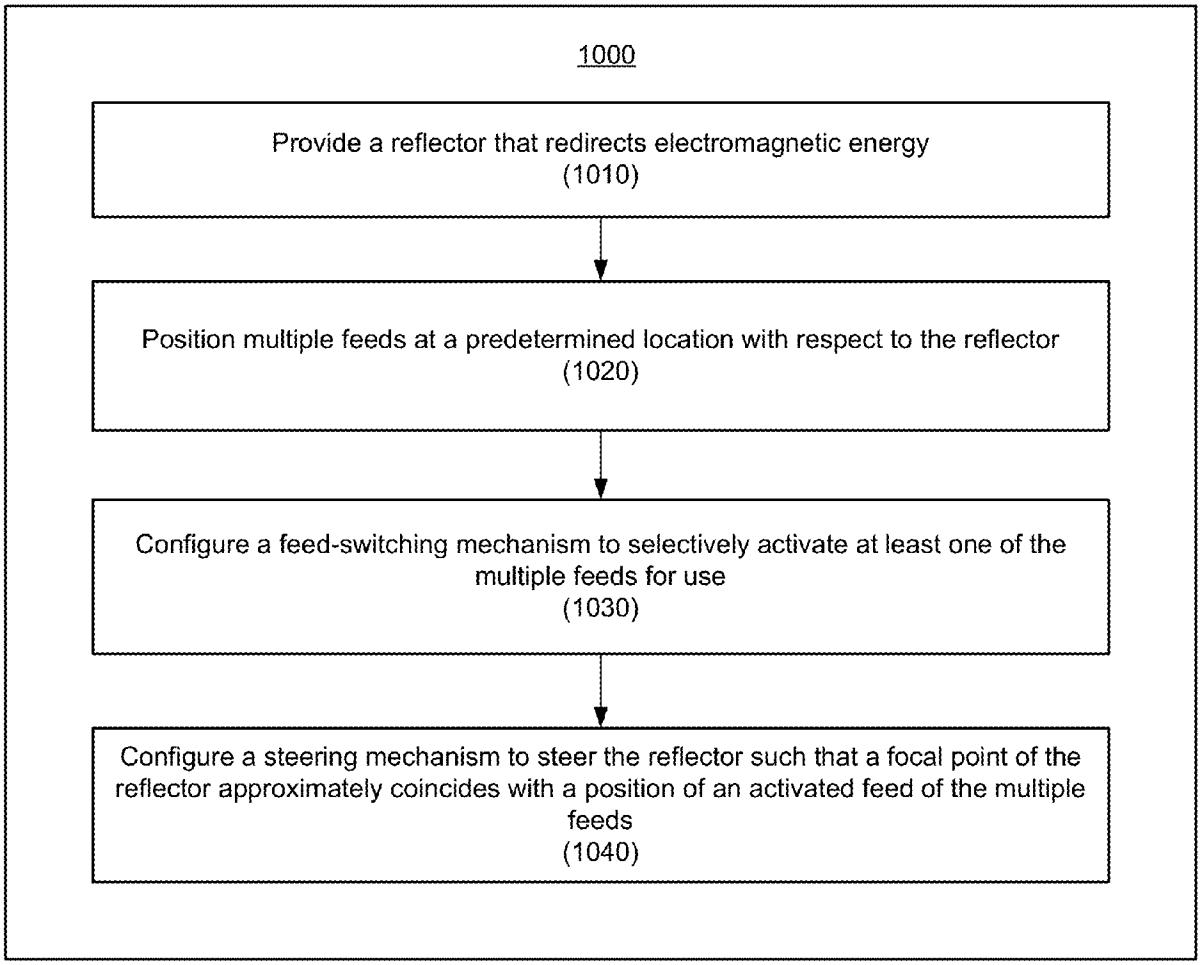
FIG. 10 is a flow diagram illustrating an example method for providing a satellite communication antenna system, according to certain aspects.

FIG. 10 is a flow diagram illustrating an example method 1000 providing a satellite communication antenna, according to certain aspects of the subject technology. The method 1000 starts at operation block 1010, where a reflector (e.g., 210 of FIG. 2) that redirects electromagnetic energy is provided. At operation block 1020, multiple feeds (e.g., 230, 232, and 234 of FIG. 2) may be positioned at a predetermined location with respect to the reflector. At operation block 1030, a feed-switching mechanism (e.g., 410 of FIG. 4) may be configured to selectively activate for use at least one of the multiple feeds (e.g., 421-425 of FIG. 4). At operation block 1040, a steering mechanism (e.g., 220 of FIG. 2) may be configured to steer the reflector such that a focal point of the reflector approximately coincides with a position of an activated feed of the plurality of feeds. The reflector may be mechanically independent of the plurality of feeds and the feed-switching mechanism.

In some aspects, the subject technology is related to multi-feed antennas (e.g., more than one, for example, five feeds or more), and in particular to antenna solutions that can provide scan performance approaching that of a fully steered system, while at the same time maintaining the cost advantages of a vertex steered system. In some aspects, the subject technology may be used in various markets, including for example and without limitation, advanced sensors, data transmission and communications, and radar and active phased array markets.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range is specifically disclosed. Also, the terms in the claims have their plain, ordinary meaning unless otherwise explicitly and clearly defined by the patentee. If there is any conflict in the usages of a word or term in this specification and one or more patent or other documents that may be incorporated herein by reference, the definitions that are consistent with this specification should be adopted.

What is claimed is:

1. An apparatus for satellite communication comprising:

a reflector configured to redirect electromagnetic energy;

a plurality of feeds, each positioned at a predetermined location with respect to the reflector;

a feed-switching mechanism configured to selectively activate for use at least one of the plurality of feeds; and a steering mechanism configured to steer the reflector such that a focal point of the reflector approximately coincides with a position of an activated feed of the plurality of feeds, wherein the steering mechanism comprises a vertex positioning mechanism including a pivot coupled to an edge of the reflector, and wherein the vertex positioning mechanism is configured to steer the reflector in a vertex configuration around the pivot.

2. The apparatus of claim 1, wherein the reflector is mechanically independent of the plurality of feeds and the feed-switching mechanism, and wherein the steering mechanism is configured to steer the reflector in the vertex configuration in at least two directions.

3. The apparatus of claim 1, wherein the apparatus comprises a low-cost and low scan-loss antenna with a performance closely approximating a performance of a fully steered antenna.

4. The apparatus of claim 1, wherein the apparatus comprises an air-borne satellite antenna, wherein the air-borne satellite antenna comprises a spot beam antenna or a shaped beam antenna.

5. The apparatus of claim 4, wherein the steering mechanism is configured to scan beams of the reflector by rotating the reflector, wherein the steering mechanism is configured to steer the reflector to a position that focuses a spot beam of the antenna on a target, wherein the target is at least one of: located on the earth, located in space, or is an air vehicle.

6. The apparatus of claim 5, wherein the predetermined location with respect to the reflector comprises a focal point of the reflector, and wherein the feed-switch mechanism comprises a network of a plurality of switches.

7. The apparatus of claim 5, wherein the feed-switching mechanism is configured to selectively activate for use the at least one feed of the plurality of feeds based on the position of the reflector that focuses the spot beam of the antenna on the target.

8. The apparatus of claim 1, wherein the apparatus comprises a multiband satellite antenna, wherein one or more of the plurality of feeds comprises a high-frequency feed, and wherein the one or more high-frequency feeds are positioned in a space in-between other feeds of the plurality of feeds.

9. The apparatus of claim 1, wherein the feed-switching mechanism is configured to selectively activate at least one feed of the plurality of feeds for use by coupling the selected at least one feed to an RF module comprising a transceiver.

10. The apparatus of claim 1, wherein the feed-switching mechanism is configured to selectively activate two or more low-frequency feeds at the same time, wherein the two or more low-frequency feeds are configured to collectively operate as an equivalent larger feed, and wherein the steering mechanism is configured to steer the reflector such that a focal point of the reflector coincides with a central point of the positions of the two or more low-frequency feeds.

11. A method for providing a satellite communication antenna, the method comprising:

providing a reflector that redirects electromagnetic energy;

positioning a plurality of feeds at a predetermined location with respect to the reflector;

configuring a feed-switching mechanism to selectively activate for use at least one of the plurality of feeds; and configuring a steering mechanism to steer the reflector such that a focal point of the reflector approximately coincides with a position of an activated feed of the plurality of feeds, wherein the steering mechanism comprises a vertex positioning mechanism including a pivot coupled to an edge of the reflector, and wherein configuring the steering mechanism comprises configuring the vertex positioning mechanism to steer the reflector in a vertex configuration around the pivot.

12. The method of claim 11, wherein the reflector is mechanically independent of the plurality of feeds and the feed-switching mechanism, and the method further comprises configuring the steering mechanism to steer the reflector in the vertex configuration in at least two directions.

13. The method of claim 11, wherein the satellite communication antenna comprises an air-borne satellite antenna comprising a spot beam antenna, and wherein the method further comprises configuring the steering mechanism to:

scan beams of the reflector by rotating the reflector, and steer the reflector to a position that focuses a spot beam of the antenna on a target, wherein the target is at least one of: located on the earth, located in space, or is an air vehicle.

14. The method of claim 11, wherein the feed-switching mechanism comprises a network of a plurality of switches, and wherein the method further comprises configuring the network of the plurality of switches to selectively activate the at least one feed of the plurality of feeds for use based on the position of the reflector that focuses the spot beam of the antenna on the target.

15. The method of claim 11, wherein the satellite communication antenna comprises a multiband satellite antenna, wherein one or more of the plurality of feeds comprises a high-frequency feed, and wherein the method further comprises positioning the one or more high-frequency feeds in a space in-between other feeds of the plurality of feeds.

16. The method of claim 11, further comprising configuring the feed-switching mechanism to selectively activate at least one feed of the plurality of feeds for use by coupling the selected at least one feed to an RF module comprising a transceiver.

17. The method of claim 11, further comprising;

configuring the feed-switching mechanism to selectively activate two or more low-frequency feeds at the same time;

configuring the two or more low-frequency feeds to collectively operate as an equivalent larger feed; and configuring the steering mechanism to steer the reflector such that a focal point of the reflector coincides with a central point of the positions of the two or more low-frequency feeds.

18. A satellite antenna comprising:

a reflector coupled to a steering mechanism and configured to redirect electromagnetic energy;

the steering mechanism configured to steer the reflector to a position that focuses a spot beam of the antenna on a target; and a feed-switching mechanism configured to selectively activate for use at least one of a plurality of feeds of a network of feeds, wherein a focal point of the reflector approximately coincides with a position of an activated feed of the plurality of feeds, wherein the steering mechanism comprises a vertex positioning mechanism including a pivot coupled to an edge of the reflector and wherein the vertex positioning mechanism is configured to steer the reflector in a vertex configuration around the pivot.

19. The satellite antenna of claim 18, wherein the reflector is mechanically independent of the plurality of feeds and the feed-switching mechanism, and wherein the steering mechanism is configured to steer the reflector in the vertex configuration in at least two directions.

20. The satellite antenna of claim 18, wherein:

the satellite antenna comprises a multiband satellite antenna, one or more of the plurality of feeds comprises a high-frequency feed, the one or more high-frequency feeds are positioned in a space in-between other feeds of the plurality of feeds, the feed-switching mechanism is configured to selectively activate two or more low-frequency feeds at the same time, the two or more low-frequency feeds are configured to collectively operate as an equivalent larger feed, and the steering mechanism is configured to steer the reflector such that a focal point of the reflector coincides with a central point of the positions of the two or more low-frequency feeds.

* * * * *